United States Patent [19]

Sadeh

[11] Patent Number: 4,498,404

[45] Date of Patent: Feb. 12, 1985

[54] AUTOMATIC SEWING APPARATUS

[75] Inventor: Yaacov Sadeh, Beersheva, Israel

[73] Assignee: Beta Engineering & Development Ltd., Beer Sheva, Israel

[21] Appl. No.: 418,389

[22] Filed: Sep. 15, 1982

[30] Foreign Application Priority Data

Jul. 23, 1982 [IL] Israel ..... 66381

[51] Int. Cl.[3] ..... D05B 21/00

[52] U.S. Cl. ..... 112/121.12; 112/121.15; 112/308; 112/DIG. 2

[58] Field of Search ..... 112/121.12, 121.15, 112/308, 309, 102, 103, 2, DIG. 1, DIG. 2, DIG. 3, 153

[56] References Cited

U.S. PATENT DOCUMENTS

| | | | |
|---|---|---|---|
| 3,072,081 | 1/1963 | Milligan et al. | 112/308 X |
| 3,448,705 | 6/1969 | Scherr et al. | 112/2 |
| 3,474,747 | 10/1969 | Noiles | 112/121.12 |
| 3,497,780 | 2/1970 | Leenhouts | 112/121.12 X |
| 3,505,966 | 4/1970 | Strothmann | 112/121.12 X |
| 3,531,107 | 9/1970 | Rovin et al. | 112/2 X |
| 3,810,436 | 5/1974 | Marforio | 112/121.15 |
| 4,419,946 | 12/1983 | Fischer | 112/308 X |
| 4,425,858 | 1/1984 | Hargett | 112/121.15 X |
| 4,434,729 | 3/1984 | Davidson | 112/121.12 |

*Primary Examiner*—Peter Nerbun

*Attorney, Agent, or Firm*—Benjamin J. Barish

[57] ABSTRACT

Sewing apparatus includes a manipulator for manipulating the workpiece on the sewing table with respect to the sewing head, the manipulator including a first arm rotatably mounted to the main frame about a first vertical axis, a second arm rotatably mounted to the first arm about a second vertical axis, a manipulatable head rotatably mounted to the second arm about a third verticle axis, and a plurality of rotary motors for rotating the first and second arms and the manipulator head about their respective axes. The manipulator head is a suction head, and the table is formed with apertures for selectively applying either positive or negative fluid pressure to its upper face in order to selectively produce either suction for holding the workpiece, or an air cushion for facilitating moving the workpiece by the manipulator. According to a still further feature, the apparatus also includes a workpiece detector continuously monitoring the location of the edge of the workpiece with respect to the sewing head.

5 Claims, 6 Drawing Figures

AUTOMATIC SEWING APPARATUS

BACKGROUND OF THE INVENTION

The present invention relates to sewing apparatus, and particularly to automatic sewing apparatus of the computerized type now gaining widespread use in the footwear and garment manufacturing industries.

Computerized sewing apparatus was introduced more than a decade ago. The currently-used apparatus generally includes X-Y servo systems having stepping motors and dedicated logic for controlling the movement of the workpiece along the X- and Y-coordinates, as well as for controlling the sewing head drive motor. One drawback generally present in the currently-used apparatus is that moving the workpiece along the X- and Y-coordinates does not always result in advancing it in the "legal" or "preferred" sewing direction. This may affect the quality of the sewing, particularly when certain types of stitching, such as top-stitching, is to be applied.

Another drawback is that the currently used systems generally require complex clamping devices for moving the workpieces with respect to the sewing head, and for retaining them in place during the sewing operations. Such clamping devices are quite costly and time-consuming to produce. Moreover, they require a loading operation which, if programmed in series with the sewing cycle, substantially increases the total production cycle time, and if programmed in parallel to the sewing cycle, substantially increases the cost by requiring the use of two or more similar clamps for every style or pattern to be sewn.

A further drawback in the current computerized sewing systems is that, although the sewing stitches can be applied very accurately by the sewing program, the workpiece itself is not always accurately cut so that the stitching applied to the workpiece may not present the best appearance. This is particularly true when the stitching is applied along the edge of the workpiece, as is frequently done in the garment and footwear industries.

SUMMARY OF THE INVENTION

An object of the present invention is to provide sewing apparatus having advantages in each of the above respects.

According to one aspect of the present invention, there is provided sewing apparatus including a main frame, a sewing head mounted thereon, a horizontal table carried by said main frame for receiving a workpiece to be sewn, and a manipulator for manipulating the workpiece on the table with respect to the sewing head. The manipulator includes a first arm rotatably mounted to said main frame about a first vertical axis, a second arm rotatably mounted to said first arm about a second vertical axis, a manipulatable head rotatably mounted to said second arm about a third vertical axis, and rotary drive means for rotating said first and second arms and said manipulator head about their respective first, second and third vertical axes. The manipulator head is a suction head and includes means for selectively applying a negative fluid pressure to its interior in order to pick up and release the workpiece. In addition, the horizontal table is formed with a plurality of apertures therethrough and includes means for selectively applying either positive or negative fluid pressure through the apertures to the upper face of the table in order to selectively produce either suction for holding the workpiece thereto, or an air cushion for facilitating moving the workpiece thereover by the manipulator.

Apparatus constructed in accordance with the foregoing features permits the workpiece to be manipulated not only along the X- and Y-coordinates, but also along a path closely simulating the manual movement of the workpiece so that the workpiece can always be programmed to move in the preferred or "legal" sewing direction with respect to the sewing head. This has been found to permit attaining higher quality stitching than in the conventional sewing apparatus in which the workpiece can be moved only along the X- and Y-directions.

Preferably, the apertured table is divided into a plurality of sections, each constituting the upper apertured wall of a chamber separately connected to a fluid source capable of producing either a positive or a negative fluid pressure to permit separate, selective control of the fluid pressure applied to said plurality of table sections. Such an arrangement has been found to further facilitate the manipulation of the workpiece in all directions, and particularly to obviate the need for the complex clamping devices heretofore required.

BRIEF DESCRIPTION OF THE DRAWINGS

Further features and advantages of the invention will be apparent from the description below.

The invention is herein described, by way of example only, with reference to the accompanying drawings, wherein.

DESCRIPTION OF A PREFERRED EMBODIMENT

Figure 1:
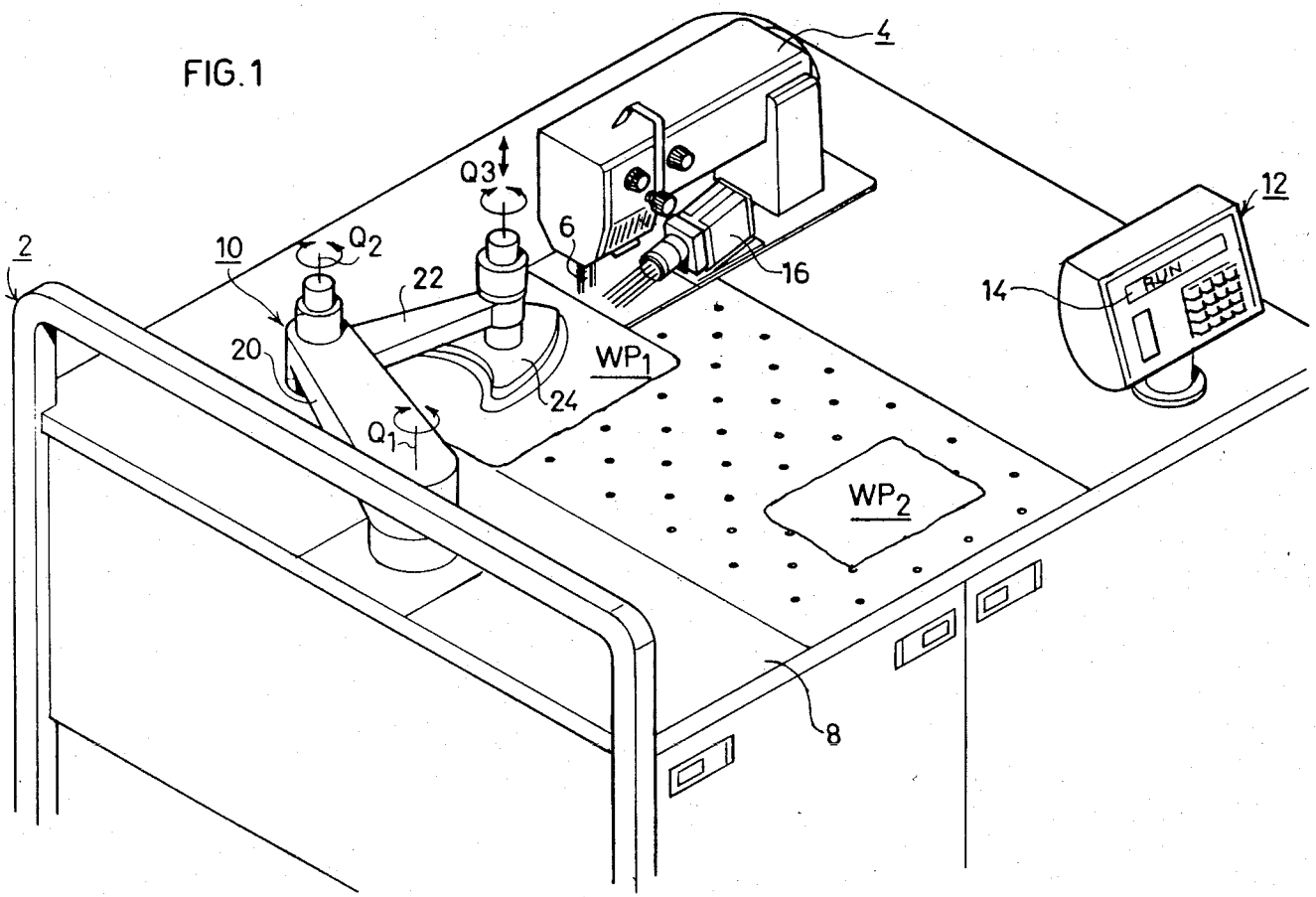
FIG. 1 is a three-dimensional view illustrating one form of computerized sewing apparatus constructed in accordance with the present invention.
Figure 4:
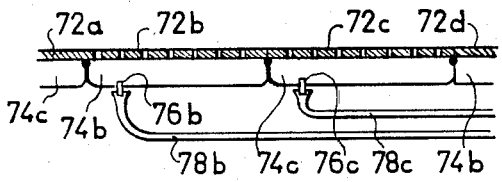
FIG. 4 is a sectional view along lines IV—IV of FIG. 3.

The sewing apparatus illustrated in FIG. 1 comprises a main frame, generally designated 2, and a sewing head 4 fixedly mounted on the main frame and driving a needle 6 located in the sewing station. The main frame 2 further includes a horizontal table 8 for receiving workpieces to be sewn, and a manipulator, generally designated 10, for manipulating the workpieces on table 8 with respect to the sewing needle 6 at the sewing station. For purposes of example, FIGS. 1 and 4 illustrate two workpieces, namely a larger workpiece $WP_1$ on top of which a smaller workpiece $WP_2$ is to be sewn.

The apparatus further includes a control panel 12 for inputting the information to be used for controlling the sewing operations to be performed. Control panel 12 further includes a display 14 displaying information concerning the sewing operations being performed or programmed to be performed.

The illustrated sewing apparatus also includes a workpiece detector, generally designated 16, oriented so as to continuously monitor the location of the edge of the workpiece with respect to the sewing needle 6 at the sewing station. Detector 16 is used, for example, for controlling the position of the workpiece during the sewing operation so as to insure that the stitches are applied uniformly at a precise predetermined distance from the workpiece edge.

Manipulator 10 is of articulated construction, and includes a first arm 20 rotatably mounted to the main frame 2 about a first vertical axis of rotation $Q_1$; a second arm 22 rotatably mounted to the end of the first arm 20 about a second vertical axis of rotation $Q_2$; and a manipulator head 24 rotatably mounted to the end of the second arm 22 about a third vertical axis of rotation $Q_3$. Manipulator head 24 is a suction head and includes means for selectively applying negative or positive fluid (e.g. air) pressure to its interior in order to pick up or release the workpiece.

Figure 2:
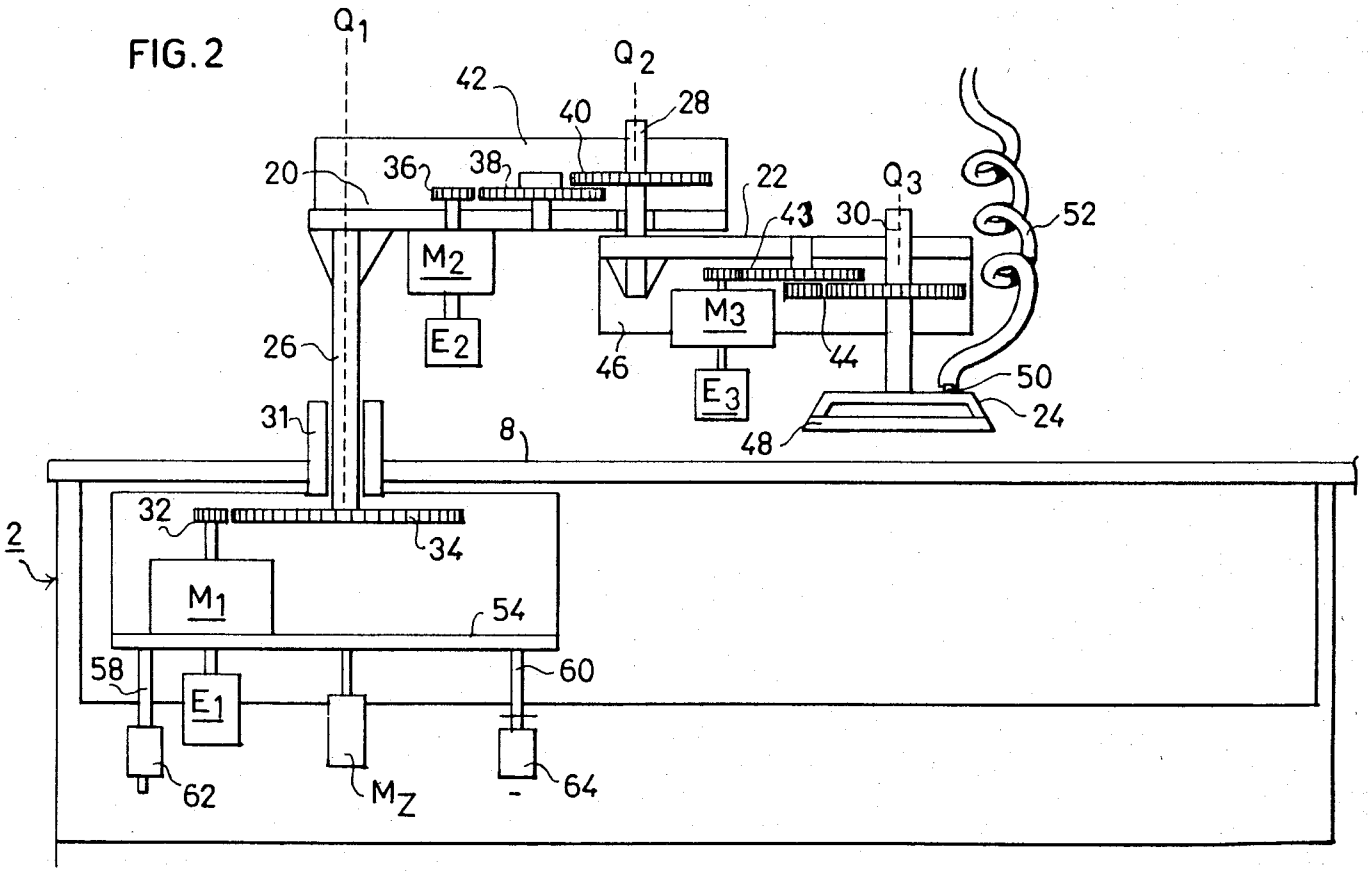
FIG. 2 is a side elevational view particularly showing the workpiece manipulator and its various drives.

The foregoing construction of the manipulator 10 is more particularly illustrated in FIG. 2. Thus, it will be seen that: rotary axis $Q_1$, about which the manipulator arm 20 may rotate with respect to the main frame 2, is defined by vertical shaft 26 extending through the horizontal table 8 of the main frame; rotary axis $Q_2$, about which manipulator arm 22 may rotate with respect to arm 20, is defined by vertical shaft 28; and rotary axis $Q_3$, about which the manipulator head 24 may rotate with respect to arm 22, is defined by shaft 30. Each of these shafts is driven by a separate rotary electric motor $M_1$, $M_2$ and $M_3$, respectively. Each shaft is also coupled to an encoder $E_1$, $E_2$ and $E_3$, respectively, providing feedback information to the control system corresponding to the operation of the respective motor.

Shaft 26, constituting the rotary axis $Q_1$, passes through a bearing 31 carried by the horizontal table 8 of the main frame 2, and is coupled to its drive motor $M_1$ via speed-reduction gearing 32, 34. Shaft 28, constituting rotary axis $Q_2$, is carried at the opposite end of manipulator arm 20 and is coupled to its drive motor $M_2$ via speed-reduction gearing 36, 38 and 40, all enclosed within a cover 42 carried by manipulator arm 20. Shaft 30, constituting the third rotary axis $Q_3$, is carried at the opposite end of manipulator arm 22 and is coupled to its drive motor $M_3$ via speed-reducing gears 43, 44 all enclosed within a cover 46 of manipulator arm 22. Manipulator head 24 is carried at the lower end of vertical shaft 30.

Manipulator head 24 may be of any desired configuration. For purposes of example, it is shown in FIG. 1 as being of generally heart-shaped configuration, but it will be appreciated that a different configuration of manipulator head, or a plurality of differently-configured heads, may be provided depending on the configuration of the workpiece to be manipulated for any particular run of the illustrated apparatus.

The lower end of manipulator head 24 is circumscribed by a skirt 48 of resilient material, such as rubber. In addition, the interior of manipulator head 24 is connected to a source of air pressure via a nozzle 50 and a tube 52, so that suction can be applied to the interior of manipulator head 24 which, together with its rubber skirt 48, will pick up a workpiece and hold it in position during transportation or sewing of the workpiece. To release the workpiece, the negative pressure producing the suction can be terminated, permitting the workpiece to release by gravity, or a positive pressure can be applied.

Manipulator 10 is also movable in the vertical direction towards and away from the horizontal table 8. For this purpose, its shaft 26, which supports its articulated arms 20 and 22 and its head 24, is mounted for vertical movement on a platform 54 disposed within the main frame 2 and vertically movable by a drive $M_Z$, platform 54 including four guide rods (only two, 58, 60, being shown in FIG. 2) movable within guide bearings 62, 64 secured to the main frame. The vertically liftable platform 54 supports not only the vertical shaft 26, but also its drive motor $M_1$ and its encoder $E_1$, together with the speed-reducing gearing 32, 34 coupling the drive motor to shaft 26.

It will thus be seen that the whole manipulator assembly 10, including its head 24, may be moved in the vertical direction towards and away from table 8 by controlling its vertical motor $M_Z$, and that the manipulator head 24 holding the workpiece can be horizontally manipulated as desired by selectively operating the three rotary motors $M_1$, $M_2$ and $M_3$. Thus, manipulator head 24 may be moved in a manner closely simulating the movement of the human hand along its three rotary axes, i.e., the shoulder, elbow and wrist. Accordingly, the workpiece gripped or manipulated by manipulator head 24 may be moved with respect to the sewing needle 6 at the sewing station through the same motions as when moved by a human operator, but in this case the movement is automatic as controlled by program. This arrangement thus permits programming the movement of the workpiece in the preferred or "legal" stitching at all times, which, as indicated earlier, substantially improves the quality of the stitiching capable of being attained by the sewing apparatus.

Horizontal table 8 is of a special construction in order to facilitate the manipulation of the workpiece without the use of the clamping devices usually required in sewing apparatus of this type. As indicated earlier, the need for such clamping devices in the current sewing machines not only adds to the cost in the use of such sewing machines, but also adds to the time for performing the preloading and/or sewing operations.

Figure 3:
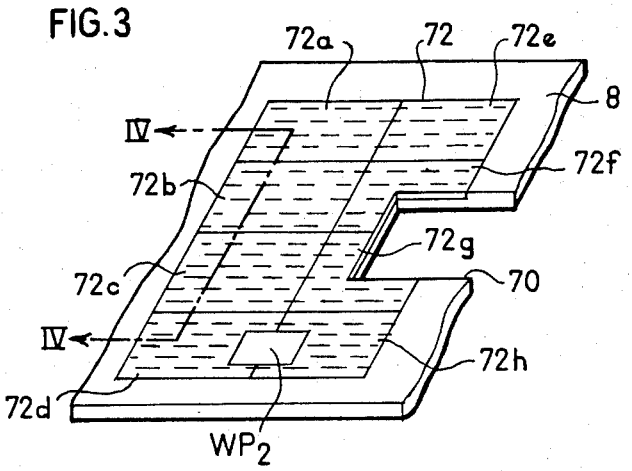
FIG. 3 is an enlarged fragmentary view illustrating the construction of the horizontal table in the sewing apparatus of FIG. 1.

The construction of the horizontal table 8 is more particularly illustrated in FIGS. 3 and 4. Thus, as shown in FIG. 3, table 8 includes a cut-out 70 accommodating the sewing head 4 and the sewing needle 6 at the sewing station. In front of the sewing station, where the workpiece is to be manipulated, horizontal table 8 includes a plate, designated 72, divided into a plurality of sections, in this case eight sections *72a–72h*. As shown particularly in FIG. 4, each table section constitutes the upper apertured wall of a separate chamber. Thus, apertured plate section *72a* is the upper end of chamber *74a*, section *72b* is the upper wall of chamber *74b*, section *72c* is the upper apertured wall of chamber *74c*, etc. Each of said chambers is separately connected to a source of positive and negative pressure by means of a nozzle (e.g., nozzles *76b*, *76c*) and a tube (e.g., tubes *78b*, *78c*), permitting each chamber to be separately and selectively subjected either to a positive fluid pressure or to a negative fluid pressure. This fluid pressure is transmitted by the apertures of the respective table section *72a–72h* to the upper face of these sections. It will be appreciated that the applications of a negative pressure to the upper face of an apertured table section will apply a suction to the workpiece supported thereon, tending to hold the workpiece in place; and the application of a positive pressure to the upper face of an apertured table section will produce an air cushion thereon, facilitating the movement of the workpiece thereover.

The apertured table sections 72a–72h may be of stainless steel sheet material having a plurality of lines of small holes drilled, etched, or otherwise formed through the sheet. By sectionalizing the apertured table in this manner, the application of suction or positive air pressure can be more accurately confined to the required surface areas, in order to maximize the suction or positive air pressure applied to the workpiece. When using the apparatus for repetitive runs of similar configuration workpieces, it may even be desirable to apply masking tape to the upper faces of the apertured table sections in order to further increase the amount of suction or positive pressure according to the particular configuration of the workpieces involved.

Figure 5:
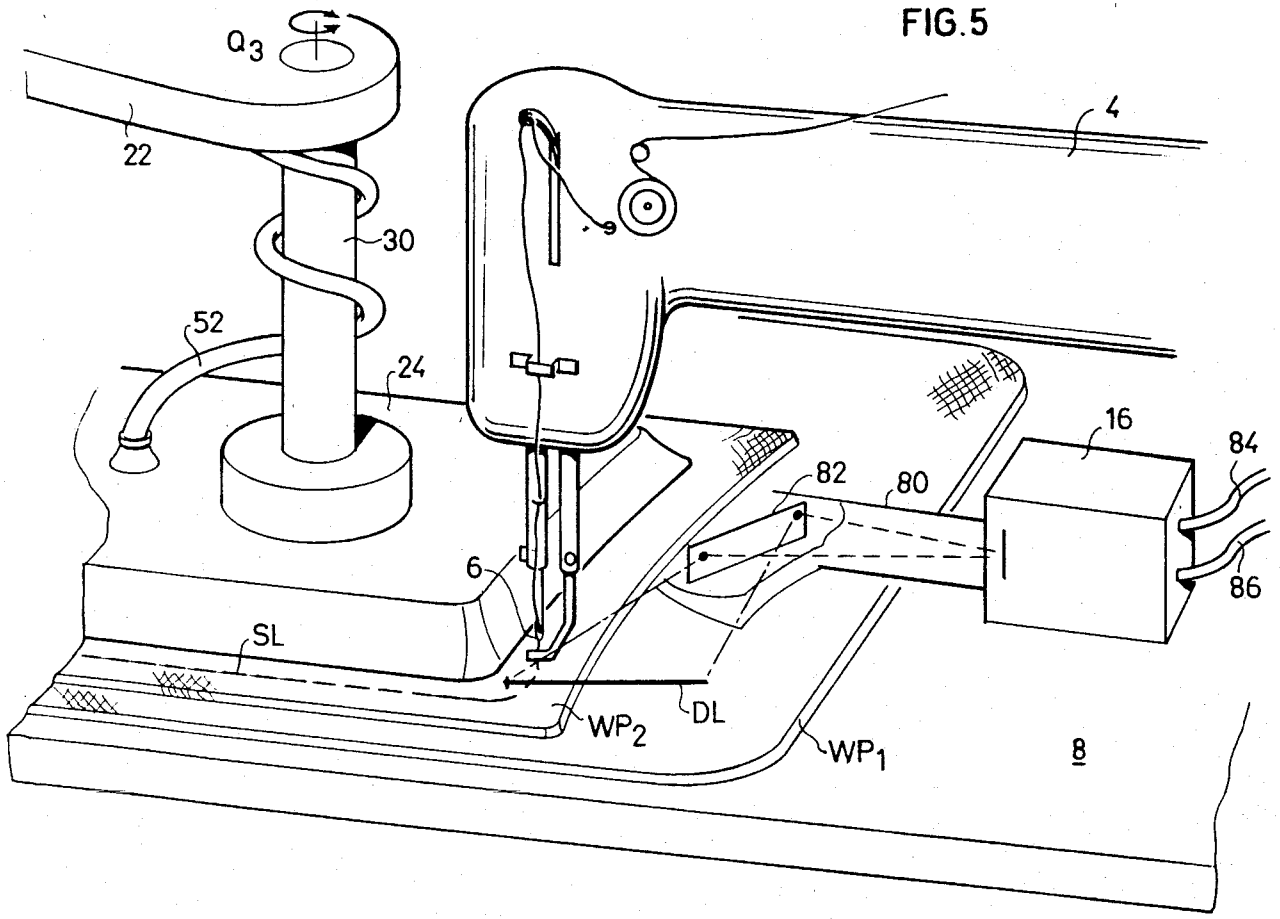
FIG. 5 is an enlarged three-dimensional view illustrating the manipulator, sewing head, and edge detector at the sewing station in the apparatus of FIG. 1.

Reference is now made to FIG. 5, which illustrates the edge detector 16 monitoring the edge of the workpiece with respect to the sewing needle 6 at the sewing station so as to control the movement of the workpiece in order to produce a uniform stitching line along the workpiece edge. Thus, as shown in FIG. 5, the smaller workpiece $WP_2$ is to be sewn along sewing line SL to the larger underlying workpiece $WP_1$, which sewing line is to be maintained at a precise uniform distance from the edge of workpiece $WP_2$ despite irregularities therein resulting from imprecise cutting of the workpiece.

The edge detector 16 may be a known type of electronic line scan camera including a linear array of tiny photodiodes. Line scan cameras of this type are presently available which contain from 64 to 1024 diodes in a single line with center-to-center spacing as small as 1 mil. The detector 16 is located and oriented so as to monitor, via an optical tube 80 including a reflector 82, the edge of workpiece $WP_2$ with respect to a line DL which is perpendicular to the preferred direction of sewing. Detector 16 is supplied by power from input line 84, and it outputs its data via output line 86, this data being used to modify the programmed control of the manipulator head 24 and workpiece $WP_2$ carried by it, so that the sewing line SL is always at the required uniform distance from the edge of the workpiece $WP_2$, thereby providing a neat and uniform appearacne to the stitching.

The operation of the sewing apparatus illustrated in the drawings will now be described particularly with reference to the block diagram of FIG. 6.

Figure 6:
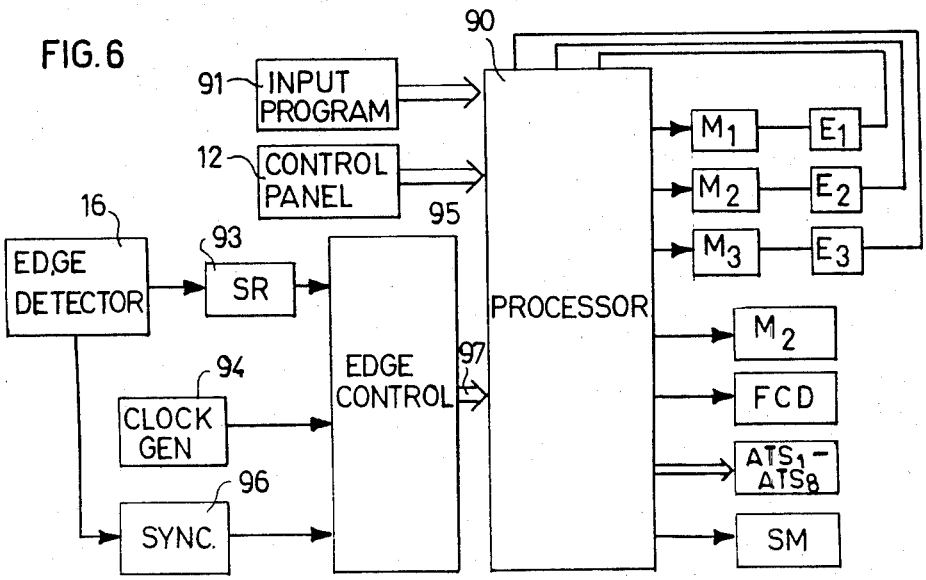
FIG. 6 is a block diagram illustrating the operation and control of the sewing apparatus of FIG. 1.

As shown in FIG. 6, the main processor, generally designated 90, is supplied with the input program 91 as in a known numerically-controlled sewing apparatus; in addition, it may be supplied with manually inputted information from the control panel 12. According to the programmed sewing operations to be performed, processor 90 controls the three rotary motors $M_1$, $M_2$ and $M_3$, to manipulate the manipulator head 24 along the three rotary axes $Q_1$, $Q_2$ and $Q_3$. Each motor $M_1$–$M_3$ is coupled to a shaft encoder $E_1$–$E_3$, respectively, to provide a closed-loop feed-back to the processor 90 of the operation of each of these motors.

Processor 90 also controls, according to the program, the linear motor $M_Z$ for driving the manipulator head 24 in the vertical direction towards and away from the horizontal table 8. The processor further controls a fluid control device, designated FCD in FIG. 6, which selectively applies positive or negative air pressure to the interior of the manipulator head 24; and further control devices $ATS_1$–$ATS_8$, which selectively apply positive or negative pressure, via the chambers (e.g., 74b, 74c, FIG. 4) to the outer faces of the apertured sections 72a–72h of the horizontal table 8. Finally, processor 91 also controls the operation of the motor SM of the sewing head 4.

A typical operating sequence might be as follows: The lower workpiece $WP_1$, to which the upper workpiece $WP_2$ is to be sewn, is first placed in position on the horizontal table 8 and is retained in that position by applying suction to the respective aperture sections 72a–72h of the table. If desired, this position of the lower workpiece $WP_1$ may be marked on the table top to facilitate its manual placement in this position, and the unnecessary holes through the top of the table section may be closed by masking tape in order to maximize the vacuum applied to the workpiece.

The manipulator head 24 is loaded with the upper workpiece $WP_2$ which is gripped by the application of suction to the interior of the manipulator head, and then the manipulator head is moved, by the appropriate operations of motors $M_1$, $M_2$ and $M_3$, to overlie the precise location at which the upper workpiece $WP_2$ is to be sewn to the lower workpiece $WP_1$. Linear motor $M_Z$ is then operated to lower the manipulator head, and the workpiece carried thereby, onto the top of workpiece $WP_1$. Positive pressure is then applied to the table section 72a–72h so as to produce an air cushion under the lower workpiece $WP_1$ while suction is still maintained in the manipulator head 24, so that both workpieces are now picked up by the manipulator head 24 and move over the air cushion to the precise position with respect to the sewing needle 6 for performing the sewing operations according to the sewing program.

It will thus be appreciated that the two workpieces which are to be sewn together are firmly supported and manipulated by the suction applied thereto by the manipulator head 24 and the air cushion applied thereunder by the apertured table sections 72a–72h, so that a firm clamping of the workpiece is effected during the sewing operations.

During the sewing operations, the edge detector 16 monitors the edge of the upper workpiece $WP_2$ with respect to a detector line DL; the latter may be located, for example, 2 millimeters from the tip of the needle 6 and perpendicular to the preferred direction of sewing. Detector 16 monitors the edge of the upper workpiece $WP_2$ by detecting the shadow along its edge; this edge, or shadow, is scanned by the detector and is fed, via a shift register 93 synchronized by a clock generator 94, to an edge control circuit 95. Detector 16 also produces sync pulses 96 applied to the edge control circuit 95 to indicate the beginning of a new scan.

The edge control circuit 95, which may be in the form of a microprocessor, transmits the edge control data to the main processor 90 via a bus 97, which may include 8 data lines, as well as "Ready" and "Acknowledge" lines. The main processor 90 thus corrects the position of the manipulator head 24 to maintain the sewing line SL exactly parallel to and uniformly spaced with respect to, the edge of the workpiece $WP_1$ irrespective of irregularities in the outline of the workpiece.

The scanning performed by the edge detector unit 16 is conducted in real time and may be done in speeds of up to 1,000 scans per second, which enables a very fast response to be made to any required changes in the position of the manipulator head 24.

After the sewing operation has been completed, the manipulator head 24 may again be used to pick up the sewn workpieces and to transport them to an unloading station, preparatory to picking up new workpieces and starting a new sewing cycle.

While the invention has been described with respect to one preferred embodiment, it will be appreciated that the invention itself, or various features thereof, could advantageously be used without other features, and in various other applications.

What is claimed is:

1. Sewing apparatus including a main frame, a sewing head mounted thereon, a horizontal table carried by said main frame for receiving a workpiece to be sewn, and a manipulator for manipulating the workpiece on the table with respect to the sewing head; characterized in that said manipulator includes a first arm rotatably mounted to said main frame about a first vertical axis, a second arm rotatably mounted to said first arm about a second vertical axis, a manipulatable head rotatably mounted to said second arm about a third vertical axis, said manipulator head being a suction head and including means for selectively applying a negative fluid pressure to its interior in order to pick up and release the workpiece, and rotary drive means for rotating said first and second arms and said manipulator head about their respective first, second and third vertical axes, said horizontal table being formed with a plurality of apertures therethrough and including means for selectively applying either positive or negative fluid pressure through said apertures to the upper face of the table in order to selectively produce either suction for holding the workpiece thereto, or an air cushion for facilitating moving the workpiece thereover by said manipulator.

2. Sewing apparatus according to claim 1, wherein said rotary drive means comprises a plurality of separate rotary motors having drive shafts for rotating said first and second arms and said manipulator head about their respective first, second and third axes, and a control system for controlling said rotary motors; said control system including shaft encoders each coupled to a drive shaft of one of said rotary motors and connected to said control system to feed back thereto information as to the operation of its respective rotary motor.

3. Sewing apparatus according to claim 3, further including a vertical drive for driving said manipulator head in the vertical direction towards and away from said horizontal table.

4. Sewing apparatus according to claim 5, wherein said manipulator and the rotary drive means therefor are carried by a platform mounted for vertical movement with respect to said main frame.

5. Sewing apparatus according to claim 6, wherein said platform includes a plurality of guide rods movable within bearings secured to the main frame.

* * * * *

UNITED STATES PATENT AND TRADEMARK OFFICE

CERTIFICATE OF CORRECTION

PATENT NO. : 4,498,404

DATED : February 12, 1985

INVENTOR(S) : Yaacov Sadeh

It is certified that error appears in the above-identified patent and that said Letters Patent is hereby corrected as shown below:

Claim 3, line 1, change "according to Claim 3" to -- according to Claim 2 --.

Claim 4, line 1, change "according to Claim 5" to -- according to Claim 3 --.

Claim 5, line 1, change "according to Claim 6" to -- according to Claim 4 --.

Signed and Sealed this

Sixth Day of January, 1987

*Attest:*

*Attesting Officer*

DONALD J. QUIGG

*Commissioner of Patents and Trademarks*